United States Patent [19]

Gallagher

[11] Patent Number: 4,629,427

[45] Date of Patent: Dec. 16, 1986

[54] LASER OPERATED SMALL ARMS TRANSMITTER WITH NEAR FIELD REFLECTION INHIBIT

[75] Inventor: Lawrence J. Gallagher, Arcadia, Calif.

[73] Assignee: Loral Electro-Optical Systems, Inc., Pasadena, Calif.

[21] Appl. No.: 796,654

[22] Filed: Nov. 8, 1985

[51] Int. Cl.[4] ..... F41F 27/00

[52] U.S. Cl. ..... 434/22; 434/21; 273/311

[58] Field of Search ..... 434/21, 22; 273/310, 273/311, 312

[56] References Cited

U.S. PATENT DOCUMENTS 4,063,368 12/1977 McFarland et al. ..... 434/22

*Primary Examiner*—Leo P. Picard

*Attorney, Agent, or Firm*—Spensley Horn Jubas & Lubitz

[57] ABSTRACT

A laser operated transmitter is attachable to the barrel of gun and comprises a battery operated power supply; a first, hit-code pulse generating circuit capable of driving a laser optical system and producing a beam simulating a projectile hitting a photodetector target system; and a second inhibit-code pulse generating circuit, synchronous with the hit-code pulse generating circuit, driving a light emitting diode and producing a hit-code inhibiting wide-angle beam aimed towards a photodetector target system worn by the shooter of the gun.

2 Claims, 3 Drawing Figures

LASER OPERATED SMALL ARMS TRANSMITTER WITH NEAR FIELD REFLECTION INHIBIT

BACKGROUND OF THE INVENTION

Tactical training systems using transmitted laser beams to simulate the firing of projectiles are presently in wide use to train troops how to fight and survive under battlefield conditions. Weapons-mounted laser transmitters are used to fire identification pulse coded beams at photodetector targets. Such laser transmitters are energized from an internal source of power, such as a battery, and are triggered either by an electrical switch on the weapon trigger, or by mechanically sensing the firing of a blank ammunition round. When laser beam having a selected pulse code above a pre-set energy level strikes a photodetector target, one or more photodetectors sense the laser code and compares the code in a boolean union to decode the information and score a hit. This has permitted realistic tactical field operations training without the hazards and costs involved in firing live ammunition.

In one-on-one combat training situations soldiers carry small arms fitted with boresighted laser transmitters which produce pulse-coded beams when triggered. They also wear garment-mounted "man-worn" photodetector target systems sensitive to the coded laser beams fired by other soldiers. When the man-worn target system of a trainee is struck by a coded laser beam having energy above a pre-set threshold level, a hit is recorded and his laser transmitter is shut off to remove him from the combat scenario.

A continuing problem has persisted in such training operations in which a direct hit of the beam from a shooter's laser transmitter is reflected from close range objects back to the shooter to be recorded as a hit on his own man-worn target system, effecting a self-kill. This has been a particular problem in urban tactics training scenarios, where firing often must be done near or even inside buildings that are usually painted with light (and therefore reflective) colors. A laser beam having an effective range of 1000 meters or will flood a room with multiple reflections of the laser beam having high enough energy to record a hit on anyone in the immediate area.

Also, since the photodetector targets consist of spaced-apart discrete detectors, the laser beams must be intentionally made broad enough in the near field to cover the space between detectors on the targets. This is done to preclude a phenomenon known as "pseudo-miss" where at close range a laser beam striking a target accurately, but between detectors, can miss the adjacent detectors and fail to record the hit.

Because of the intentional near field beam broadening there is sufficient off-axis energy in the beam at close range to reflect back to the shooter at an energy level above the hit threshold of his man-worn target system. This may be independent of, or added to, the reflections of the principal collimated beam. Therefore a soldier could accurately aim a perfect shot at an "enemy" target, and the reflections of the of the beam from a wall, trees, brush, or any light-colored ground clutter could cause a trainee, performing exactly the correct combat procedure, to "shoot himself" and be taken out of the scenario; perhaps along with other members of his squad who may be too close to him.

SUMMARY OF THE INVENTION

It is a primary purpose of the present invention to provide a laser operated small arms transmitter simulating the trajectory of a projectile, in which a direct hit of the shooter's coded laser beam on a reflective surface and reflected back towards the shooter will not be decoded as a hit on the photodetector target system of the shooter.

It is a further purpose of the present invention to provide a laser operated small arms transmitter simulating the trajectory of a projectile, in which the off-axis near-field energy of the laser beam reflected back towards the shooter from ground clutter will not be decoded as a hit on the photodetector target system of the shooter.

The achievement of the foregoing purposes of the present invention is acomplished with a laser operated transmitter attachable to the barrel of small arms gun and comprising a battery operated power supply; a code pulse generating circuit capable of driving a laser optical system, producing a beam carrying a hit-indication code pulse train and simulating a projectile hitting a photodetecting target system; and a second pulse generating circuit, synchronous with the hit-indication code pulse generating circuit, driving a light emitting diode and producing a hit-code inhibiting wide-angle beam aimed towards a photodetecting target system worn by the shooter of the gun.

DETAILED DESCRIPTION OF THE DRAWINGS

Figure 1:
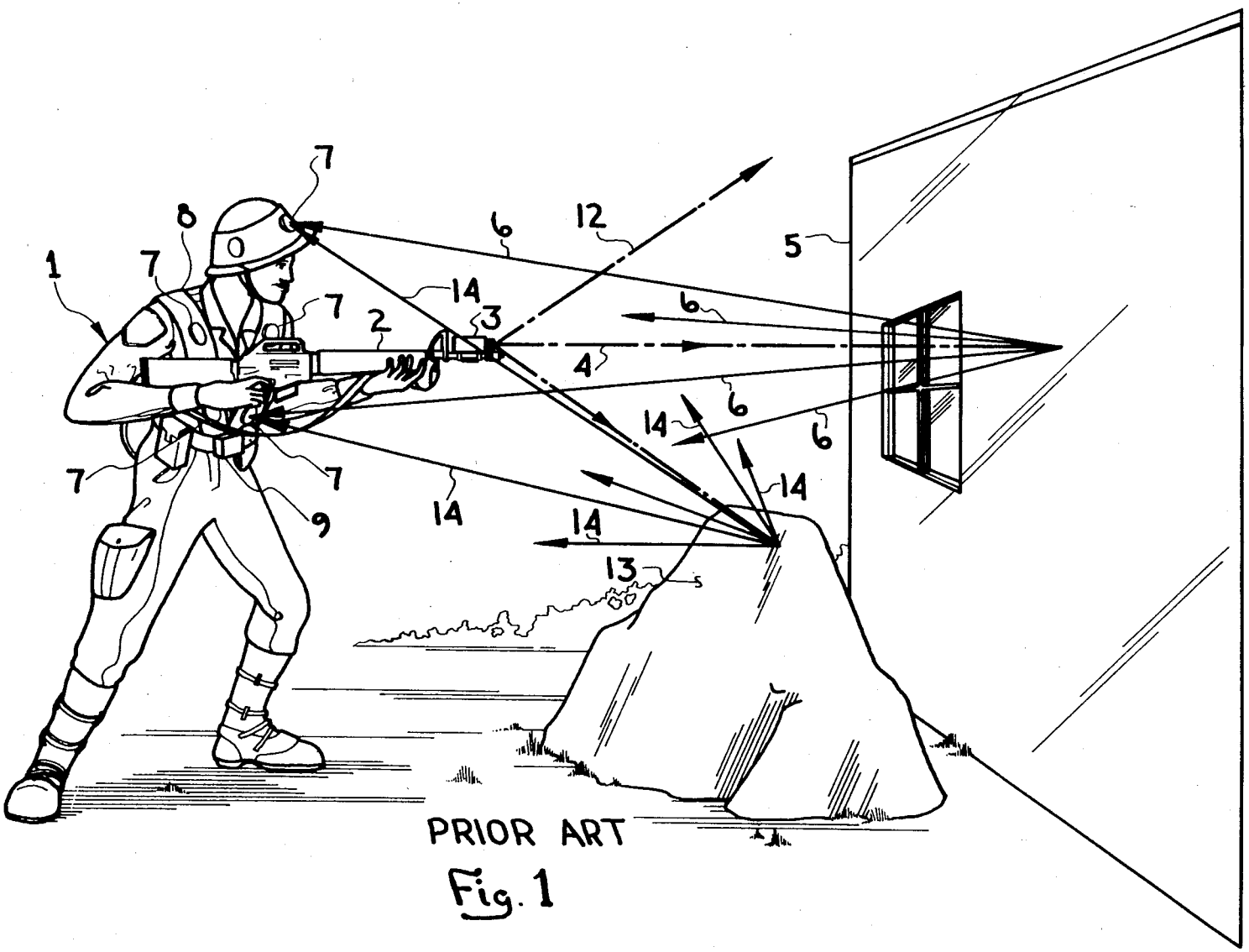
PRIOR ART Fig. 1
FIG. 1 is a perspective view of a soldier in a typical combat training scenario and firing a rifle equipped with prior art laser operated small arms transmitter.

In FIG. 1 a soldier 1 is shown firing a rifle 2 equipped with a laser operated small arms transmitter 3, generating and aiming a pulse coded and generally collimated laser beam 4 from an internal source of power, such as a battery, towards a reflective surface 5. Reflected energy 6 is received by photodetectors 7 on a man-worn target system 8 worn by soldier 1. The man-worn target system 8 is provided with a decoder 9 that will record a hit when the code energy above a pre-set threshold is received by one or more of the photodetectors 7, and shuts off transmitter 3 to remove soldier 1 from the battlefield scenario.

Also in FIG. 1 transmitter 3 is shown producing a lower level wide angle beam 12, also reflecting from a near-field surface 13 and causing reflected energy 14 to be received by photodetectors 7 and if the pulse code energy is above the preset energy threshold the decoder 9 also shuts off transmitter 3 to remove the soldier from the battlefield scenario. Since the source of both the collimated energy in beam 4 and the wide beam energy 12 are from the same pulse coded laser, the reflected energy from both portions of the beam remain synchrounous and therefore additive to reach the pre-set energy level to falsly indicate the hit on the soldier.

Figure 2:
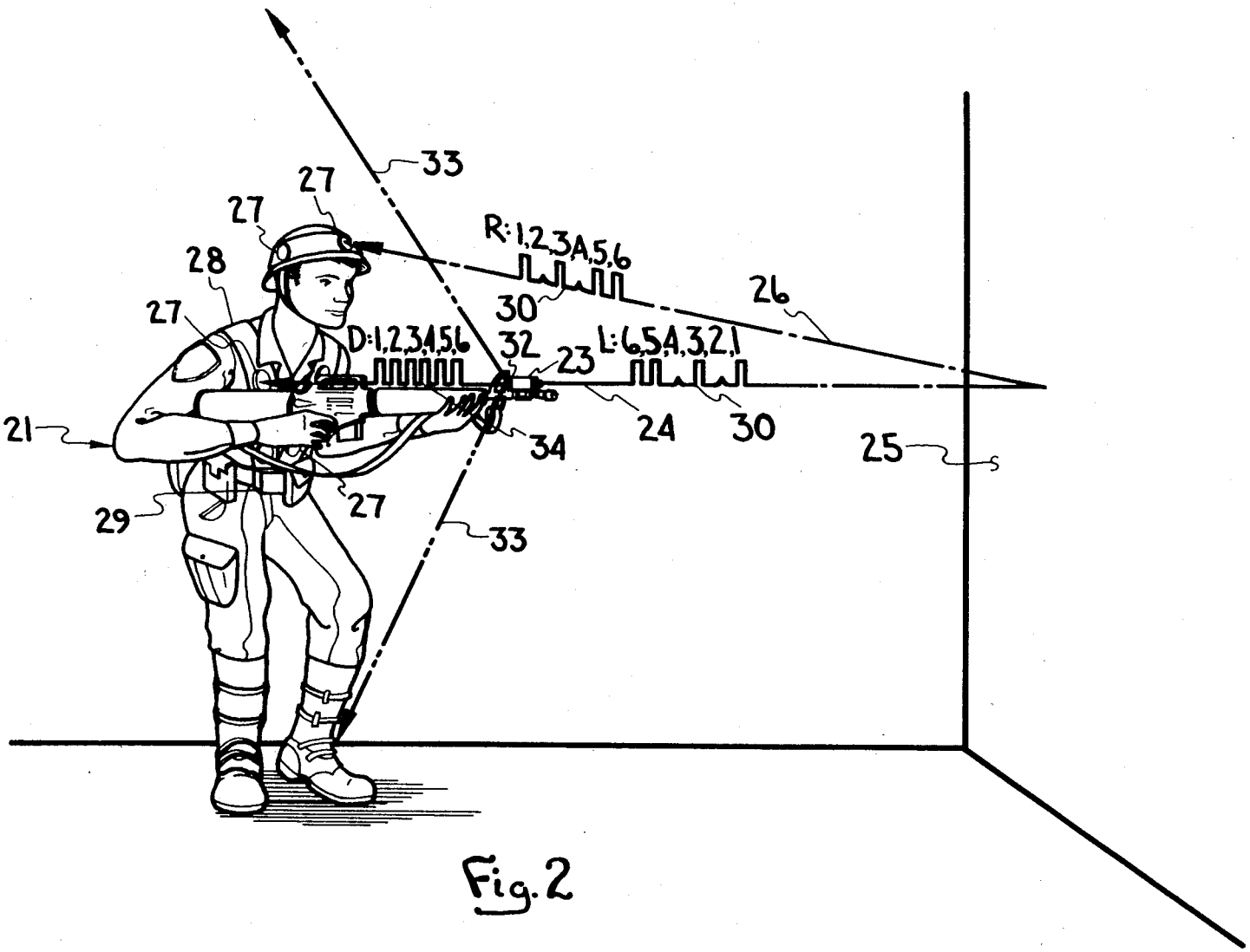
FIG. 2 is a perspective view of a soldier in a typical combat training scenario and firing a rifle equipped with a laser operated small arms transmitter according to the present invention.

In FIG. 2 a soldier 21 is shown firing a rifle 22 equipped with a laser operated small arms transmitter 23, according to the present invention, and generating and aiming a pulse coded and collimated laser beam 24 from an internal source of power, such as a battery, towards a reflective surface 25. Reflected energy 26 is received at photodetectors 27 on a man-worn target system 28 worn by soldier 21. The man-worn target system 28 is provided with a decoder 29 that will record a hit when the appropriate coded word is received having energy above a pre-set threshold is received by one or more of the photodetectors 27. In order to record a hit the pulse code word 30 of laser beam 24, illustrated as a 6 slot laser word L:1,2,3,4,5,6 having bits in slots L:1,3,5,6, is reflected from surface 25 as reflected beam 26, as 6 slot reflected word R:1,2,3,4,5,6, also having bits in slots L:1,3,5,6.

Included within transmitter 23 is a light emitting diode 32, producing a wide angle beam 33, having a pulse code generated also from the internal source of power, synchronized with laser beam 24. Wide angle beam 33 is modulated with pulse code 34, illustrated as a 6 slot diode word D:1,2,3,4,5,6, having every slot filled. Therefore decoder 29 cannot identify the hit code word 30, as all slots in the word are filled by data bits in code word 34, and the hit code requires empty slots at positions 2 and 4 to record a hit. In this arrangement the shooter, and possibly the members of his squad close enough to be accidentally "killed" by the reflected pulse coded energy 26, would be protected by the kill-inhibiting code 34 from the light emitting diode.

Figure 3:
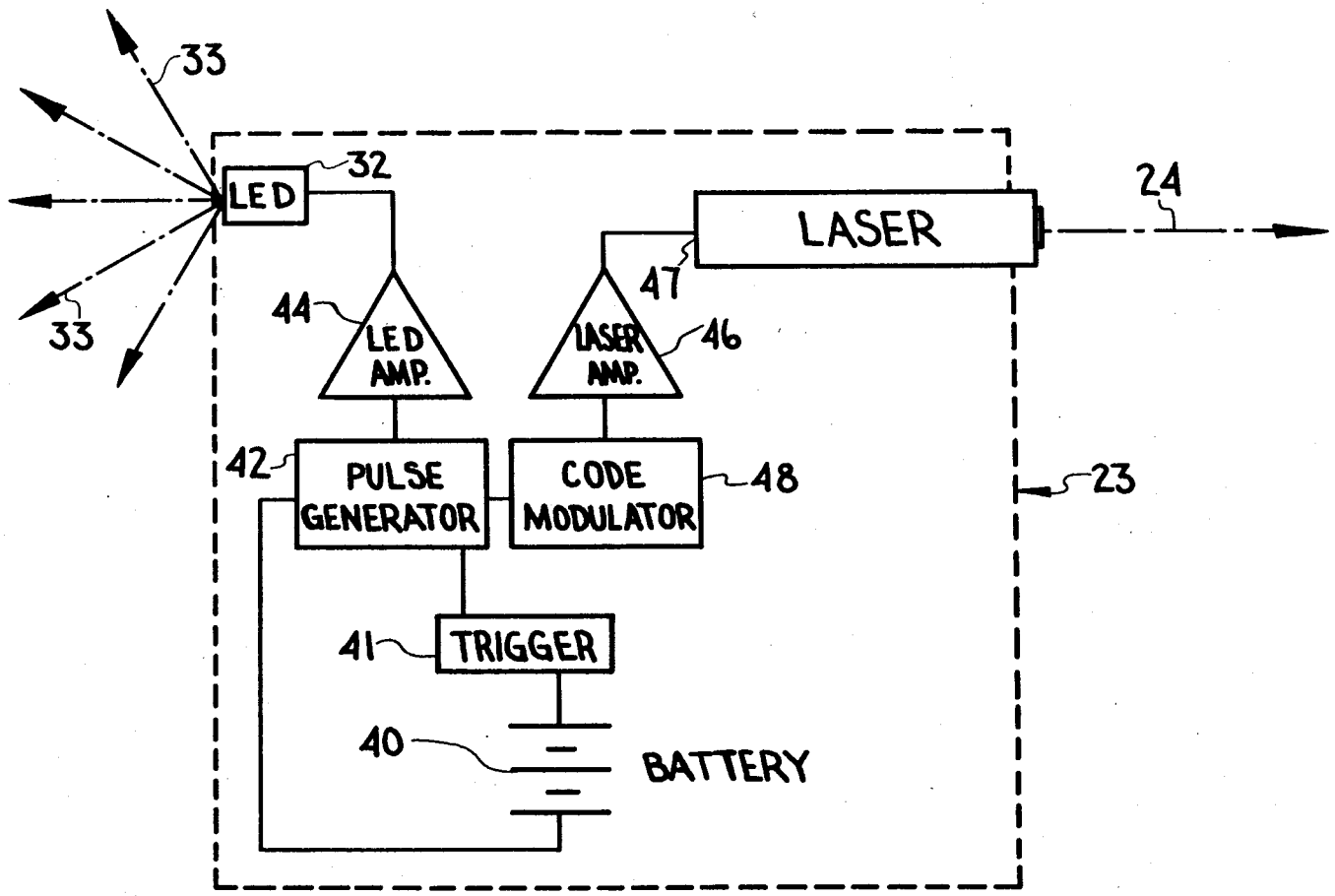
FIG. 3 is a simplified schematic block diagram of a laser transmitter according to the present invention.

In FIG. 3 a schematic block diagram is of transmitter 23 is shown having a battery 40 connected by a trigger means to a pulse generator 42. Pulse generator 42 is connected to the LED amplifier, in turn connected to the light emitting diode 32 and produce a code inhibiting pulse train. Pulse generator 42 is also connected to a code modulator 48 to modulate the pulse train into a code word pattern, amplified by amplifier 46, to drive the laser 47 and produce the pulse coded laser beam 24.

I claim:

1. A laser operated small arms transmitter attachable to the barrel of a gun for producing a coded laser beam simulating the trajectory of a projectile comprising:

a laser optical means including hit code pulse generating means and an internal power source means and an internal power source means whereby said laser optical means produces a beam simulating a projectile directed toward a photodetector target system;

a light emitting diode optical means including a second inhibit code pulse generating means whereby a hit code inhibiting wide angle beam, synchronous with said hit code pulses, is produced and directed towards the photodetector target system worn by the shooter of the gun.

2. A laser operated small arms transmitter according to claim 1 whereby said hit pulse generating means includes means to produce a code comprising a plurality of bit slots wherein at least one bit slot is not filled and said second inhibit code pulse generating means includes means to produce a code comprising a plurality of bit slots wherein all the bit slots are filled with bits, said bits having an energy level at least as high as the hit code pulse bits.

* * * * *